US008142647B2

(12) United States Patent
Wei et al.

(10) Patent No.: US 8,142,647 B2
(45) **Date of Patent: *Mar. 27, 2012**

(54) ADSORPTION OF DIBENZOTHIOPHENES FROM HYDROCARBON AND MODEL DIESEL FEEDS

(75) Inventors: Xiaolin Wei, Beijing (CN); Scott M. Husson, Greenville, SC (US); Marcus V. Dutra e Mello, Moraga, CA (US); Daniel Chinn, Bay Point, CA (US); Zunqing He, San Rafael, CA (US)

(73) Assignee: Chevron U.S.A. Inc., San Ramon, CA (US)

( * ) Notice: Subject to any disclaimer, the term of this patent is extended or adjusted under 35 U.S.C. 154(b) by 584 days.

This patent is subject to a terminal disclaimer.

(21) Appl. No.: 12/336,199

(22) Filed: Dec. 16, 2008

(65) Prior Publication Data

US 2010/0147748 A1 Jun. 17, 2010

(51) Int. Cl.
*C10G 25/06* (2006.01)

(52) U.S. Cl. ..... 208/236; 208/237; 208/240; 208/245; 585/820

(58) Field of Classification Search ..... 208/236, 208/237, 240, 245; 585/820
See application file for complete search history.

(56) References Cited

U.S. PATENT DOCUMENTS

| | | | | |
|---|---|---|---|---|
| 3,202,726 | A * | 8/1965 | Malmberg et al. | 585/816 |
| 5,134,242 | A | 7/1992 | Le et al. | |
| 5,955,641 | A * | 9/1999 | Chen et al. | 585/320 |
| 6,177,601 | B1 | 1/2001 | Bogdan et al. | |
| 7,439,409 | B1 | 10/2008 | Jan et al. | |
| 2005/0173297 | A1 * | 8/2005 | Toida | 208/14 |
| 2009/0076221 | A1 * | 3/2009 | Wei et al. | 525/102 |

OTHER PUBLICATIONS

Milenkovic et al. Selective elimination of alkyldibendothiophenes from gas oil by formation of insoluble charge-transfer complexes. Energy and Fuels 1999, 13, 881-887.*

PCT International Search Report and Written Opinion, International Application No. US2009/066250, dated Jun. 21, 2011, pp. 1-5.

* cited by examiner

*Primary Examiner* — Lorna M Douyon
*Assistant Examiner* — Amina Khan

(57) ABSTRACT

A process for adsorbing aromatic sulfur compounds, where an adsorbent is contacted with a $C_6$-$C_{20}$ aromatic and/or aliphatic stream which comprises a solution of (i) at least one benzothiophene compound, (ii) a solvent which comprises at least one $C_6$-$C_{16}$ aliphatic compound, and (iii) optionally at least one $C_6$-$C_{12}$ aromatic compound. In this process, the adsorbent is regenerated using an organic regenerant such as, but not limited to, toluene. Also disclosed is another process for adsorbing aromatic sulfur compounds. In this process, an adsorbent is contacted with a mixture comprising a model diesel feed comprising at least one benzothiophene compound. In this process, the adsorbent is regenerated using an organic regenerant such as, but not limited to, toluene.

20 Claims, No Drawings

ADSORPTION OF DIBENZOTHIOPHENES FROM HYDROCARBON AND MODEL DIESEL FEEDS

FIELD OF THE INVENTION

The present invention is related to processes for adsorbing aromatic sulfur compounds from hydrocarbon and model diesel feeds.

BACKGROUND OF THE INVENTION

The removal of sulfur from gasoline fuel demands attention worldwide, not only because of the need to reduce atmospheric pollution by sulfur oxides, but also because of the need to make ultra-low sulfur fuels for hydrocarbon fuel processors used in fuel cell applications. EPA regulations put forward in 2001 require that gasoline sulfur content must be ≦30 ppmw, and highway diesel sulfur content should be ≦15 ppmw in 2009.

The common types of sulfur compounds in various distillate fuel fractions include sulfides, disulfides, thiols, thiophenes, benzothiophenes, methyl-benzothiophenes, dibenzothiophenes, and methyl-substituted dibenzothiophenes. The presence of sulfur compounds in commercial fuels is highly undesirable. These compounds are corrosive to metals, poison catalysts in hydrocarbon fuel processors, and they contaminate the environment in the form of sulfur oxides emitted in engine exhaust.

Currently, the extent of petroleum feedstock desulfurization depends on the catalytic hydrodesulfurization process (HDS), where the sulfur compounds lose sulfur by hydrogenation reactions, giving off $H_2S$ as one of the treatable products. Hydrotreating is a commercially proven and simple refining process, and refineries with hydrotreaters produce deeply desulfurized gas oil on straight-run distillates by modifying catalysts and operating conditions. However, greater challenges are expected for desulfurizing distillate streams such as Light Cycle Oil (LCO), requiring either substantial revamps to equipment or construction of new units. Specifically, hydrotreating LCO requires a higher reactor pressure, as well as an increased hydrogen rate and purity. Furthermore, distillates from Fluid Catalytic Cracking (FCC) operations contain higher concentrations of compounds with aromatic rings, which make deep desulfurization more difficult. For these reasons, new technology developments are needed for the ultra-deep desulfurization of these feedstocks.

In order to reduce the cost of deep-desulfurization, several new technologies have been introduced in the experimental stages. Among them, sulfur adsorption, sulfur oxidation and biodesulfurization seem to be quite promising. The major advantages of these new technologies include lower costs, lower processing temperatures and pressures, reduced emissions of gaseous pollutants and carbon dioxide, and no hydrogen requirement. In general, the sulfur adsorption processes use specific adsorbents that interact with the sulfur-containing compounds to separate them selectively from the hydrocarbon mixtures. This technology seems particularly favorable for gasoline desulfurization because the process does not modify the hydrocarbon components, thereby avoiding any loss in octane rating.

In commercial diesel, the major sulfur compounds are thiophene, benzothiophene, dibenzothiophene, and their alkyl derivatives. This fact indicates that the reactivities of alkyl-substituted benzothiophenes (BT) and dibenzothiophenes (DBT) are much lower during catalytic hydrotreating than those of other sulfur-containing molecules. Kabe et al. reported that although the alkyl group substitutions of DBT do not inhibit the adsorption of DBT's on catalysts via π-electrons in the aromatic rings, the C—S bond cleavage of adsorbed DBT's is disturbed by steric hinderance of the alkyl group(s). Kabe, T.; Ishihara, A.; Zhang, Q. *Deep desulfurization of light oil. Part 2: hydrodesulfurization of dibenzothiophene, 4-methyldibenzothiophene and 4,6-dimethyldibenzothiophene*. Appl. Catal. A 1993, 97, L1-L9. Consequently, in the ultra-deep desulfurization process, the removal of these substituted DBT's is of greatest interest for refineries.

Because DBT's are electron rich, they form charge transfer complexes (CTC) with suitable electron acceptors. For this reason, reversible complexation of DBT's by π-acceptors can be used as a separation strategy to recover DBT's. One technical challenge to overcome in order to use reversible complexation as the strategy for DBT removal from gasoils is that gasoils contain numerous other aromatic compounds that also can donate electrons to form CTC's with the acceptor compound. For this reason, the acceptor compound (or, more generally, the separation agent) needs to be selective toward the DBT's. To tackle this critical need, we have previously (i) prepared and tested a TAPA functionalized adsorbent that incorporates π-acceptor groups known to be efficient and selective for binding DBT's; (ii) addressed that this adsorbent should maintain capacity in the presence of significant volume percentages of aromatics; and (iii) addressed that this adsorbent is regenerable (i.e. complexation is reversible), as fully described in commonly assigned, pending U.S. patent application Ser. No. 12/134,311, the entire disclosure of which is hereby incorporated by reference in its entirety. We now address three issues pertaining to the use of TAPA functionalized adsorbents: (i) adsorption of 4,6-DMDBT in the presence of competing aromatics, (ii) co-adsorption of 4,6-DMDBT and dibenzothiophene from model diesel, and (iii) solvent regeneration of adsorbents with a toluene regenerant.

SUMMARY OF THE INVENTION

One aspect of this invention is directed to one process for adsorbing aromatic sulfur compounds. In this process, an adsorbent is contacted with a $C_6$-$C_{20}$ aromatic and/or aliphatic stream which comprises a solution of (i) at least one benzothiophene compound, (ii) a solvent which comprises at least one $C_6$-$C_{16}$ aliphatic compound, and (iii) optionally at least one $C_6$-$C_{12}$ aromatic compound. In this process, the adsorbent is regenerated using an organic regenerant such as, but not limited to, toluene.

Another aspect of the invention is directed to another process for adsorbing aromatic sulfur compounds. In this process, an adsorbent is contacted with a mixture comprising a model diesel feed comprising at least one benzothiophene compound. In this process, the adsorbent is regenerated using an organic regenerant such as, but not limited to, toluene.

DETAILED DESCRIPTION OF THE INVENTION

This invention is directed to processes for adsorbing aromatic sulfur compounds from at least one hydrocarbon stream by contacting this stream with an adsorbent material. Such hydrocarbon streams may include naphtha, gasoline, commercial diesel fuel, model diesel fuel, or jet fuel. Preferably, the hydrocarbon stream is (i): a $C_6$-$C_{20}$ aromatic and/or aliphatic stream, or more preferably a $C_7$-$C_{16}$ aromatic and/or aliphatic stream, or (ii) model diesel fuel, which comprises a fuel which has a $C_{10}$-$C_{16}$ range including aromatics, aliphatics, cycloparaffins, paraffins, and isoparaffins. The aromatic sulfur compounds refer to any "benzothiophene compounds" which means both benzothiophene ("BT") and its homologues, for example dibenzothiophene ("DBT"), and the mono-, di- or trisubstituted derivatives of these, for example dialkyl, trialkyl, alkenyl and aryl benzothiophenes.

The hydrocarbon stream is contacted with a suitable adsorbent material on a support material, typically silica, until the adsorbent material becomes saturated. In this invention, porous silica gel is functionalized with 2,4,5,7-tetranitro-9-fluorenone to create a 2,4,5,7-Tetranitro-9-fluorenylideneaminooxy propionic acid (TAPA) functionalized adsorbent that binds DBT's via reversible charge transfer complexation. Electron acceptors of the fluorenone series are of considerable interest in the study of charge transfer complexes. They have semiconducting and photoconducting properties, and serve as electron transport materials. Nitro-group derivatives of 9-fluorenone and 9-dicyanomethylenefluorenone are among the best known electron acceptors. The 2,4,5,7-tetranitro-9-fluorenone is covalently tethered to a silica gel support material and 4,6-dimethyldibenzothiophene (4,6-DMDBT) was selected as the target adsorptive to test this newly developed adsorbent, and following synthesis and characterization of the new adsorbent, batch adsorption studies were carried out to measure the binding capacities of the adsorbent for 4,6-DMDBT and to determine the enthalpy change on adsorption, as fully described in commonly assigned, pending U.S. patent application Ser. No. 12/134,311, the entire disclosure of which is hereby incorporated by reference in its entirety. We now discuss in more detail three issues pertaining to the use of TAPA functionalized adsorbents: (i) adsorption of 4,6-DMDBT in the presence of competing aromatics, (ii) co-adsorption of 4,6-DMDBT and dibenzothiophene from model diesel, and (iii) solvent regeneration of adsorbents with a toluene regenerant, in the following non-limiting examples and experimental conditions.

EXAMPLES

Competitive Adsorption Studies and Regeneration of Adsorbents

All chemicals were used as received, except where noted. Percentages refer to wt-%. 9-Fluorenone (98%), toluene (anhydrous, 99.8%), n-heptane (99+%, HPLC grade), potassium bromide (>99.0%, ACS reagent), tetrabutylammonium bromide (TBAB, 99%), 3-glycidyloxypropyl trimethoxysilane (3-GPTMS, 98%), 4,6-dimethyldibenzothiophene (4,6-DMDBT, 97%), 2,6-dimethylnaphthalene (DMN, 99%), and dibenzothiophene (DBT, 99%) were purchased from Sigma-Aldrich. The 2,4,5,7-Tetranitro-9-fluorenylideneaminooxy propionic acid (TAPA) was prepared according the synthesis procedure as fully described in commonly assigned, pending U.S. patent application Ser. No. 12/134,311, the entire disclosure of which is hereby incorporated by reference in its entirety.

Two silica gel support materials were used to prepare TAPA-functionalized adsorbents; they are denoted as types I and II in this publication. Silica-I was provided by Grace GmbH & Co. KG (Worms, Germany); it has an irregular particle shape, average particle size of 20 nm, average pore size of 100 nm, surface area of 40 $m^2/g$, and a pore volume of 1.05 ml/g. Silica-II was purchased from Sigma-Aldrich; it has a particle size range from 37 to 75 nm, an average inner pore diameter of 6 nm, and surface area of 480 $m^2/g$.

Grafting TAPA to the Support Surface

A two-step synthesis was used to prepare TAPA-functionalized adsorbents. 3-GPTMS was reacted onto silica-I and silica-II, followed by reaction with TAPA using TBAB as catalyst. Details of this synthesis and characterization by diffuse-reflectance FTIR and thermal gravimetric analysis are fully described in commonly assigned, pending, U.S. patent application Ser. No. 12/134,311, the entire disclosure of which is hereby incorporated by reference in its entirety.

Batch Competitive Adsorption Studies

Known masses (typically 0.1 to 0.2 g) of TAPA-functionalized adsorbent were contacted with known volumes (typically 5 ml) of a hydrocarbon feedstock solution. Solutions that were tested include mixtures of (i) at least one benzothiophene compound and optionally a naphthalenic compound and (ii) a solvent comprising at least one $C_6$-$C_{16}$ aliphatic compound, and optionally at least one aromatic compound. In particular, solutions that were tested include mixtures of 4,6-DMDBT and DMN in n-heptane and n-heptane/toluene mixtures, and a model diesel containing both 4,6-DMDBT and DBT. For studies with n-heptane and n-heptane/toluene mixtures, initial 4,6-DMDBT and DMN concentrations were below 505 ppm, and the initial atomic sulfur concentration was 78 ppm. For the model diesel, the feed was spiked with at least one benzothiophene compound, in particular, with 4,6-DMDBT and DBT, and the initial total atomic sulfur concentration was 86 ppm. The samples were placed in a constant-temperature, reciprocating shaker bath at 150 rpm for 24 h. Adsorption kinetics were studied previously to confirm that 24 h is sufficient time to reach equilibrium under these agitation conditions. The initial and final 4,6-DMDBT, DBT and DMN concentrations were determined by gas chromatography (GC), and measurements were done using the same GC conditions that were used to develop the calibration curve.

Regeneration of 4,6-DMDBT and DBT-Loaded Silica

Regenerating the adsorbent can be important so that it can be reutilized for another adsorption cycle, thus providing for cost savings. Adsorbent regeneration was performed as follows: In one set of experiments, TAPA-functionalized silica-I was loaded with 4,6-DMDBT from solutions of 4,6-DMDBT in n-heptane to various binding capacities, ranging from 9 to 18 mg DMDBT/g adsorbent. In a second set of experiments, silica-I and silica-II were loaded with both 4,6-DMDBT and DBT from the model diesel. Loaded samples were filtered and dried under vacuum at room temperature. For regeneration, the loaded silicas were contacted with a $C_6$-$C_8$ aromatic compound as the regenerant, in particular, toluene, in a reciprocating shaker bath with a shaking speed of 150 rpm and a constant temperature of 70° C. to reach equilibrium. The regeneration may also take place at a temperature between 50° C. and 100° C. Solution samples were collected at 2 hrs and again at 24 hrs and analyzed by GC for 4,6-DMDBT and DBT concentrations. We found that 2 hrs was sufficient contacting time to reach equilibrium during regeneration.

Analytical Methods

The gas chromatography instrument (GC 6890) was from Hewlett Packard; it used an on-column injection with a 25 m×0.3 mm fused silica capillary column coated with DB 5 [(5%-phenyl)-methylpolysiloxane, J & W Scientific] and coupled to an flame ionization detector by a heat transfer line. The analysis temperature program was described earlier in this section.

The calibration curves for 4,6-DMDBT and DBT were established by using 9-fluorenone as internal standard at a concentration of 72.5 ng/nL. For DMN, n-octanol was used as internal standard. The internal response factors (IRF) for 4,6-DMDBT, DBT, and DMN were determined to be 1.017, 1.177, and 0.741. After GC analysis of test samples with unknown concentrations of 4,6-DMDBT, DBT or DMN, sample concentrations were calculated using Equation 1, where IS indicates internal standard and i represents compound i.

$$Conc._i = \frac{Conc._{IS} \times \text{Area}_i \times IRF_i}{\text{Area}_{IS}} \quad \text{(Equation 1)}$$

Results and Discussion a. Competitive Adsorption Studies for TAPA-Functionalized Silicas Silica-I was used for this part of the work. It was prepared by the direct grafting method fully described in commonly assigned, pending, U.S. patent application Ser. No. 12/134,311, the entire disclosure of which is hereby incorporated by reference in its entirety. The competitive adsorption study was conducted with 2,6-dimethylnaphthalene as the control compound, and three different solvents were used. Solution I, containing 4,6-DMDBT (505 ppm), giving an initial total atomic sulfur concentration of 76 ppm, and DMN (497 ppm), was prepared using pure n-heptane as the solvent; while solutions II and III, containing 4,6-DMDBT (498 ppm), giving an initial total atomic sulfur concentration of 75 ppm, and DMN (476 ppm), were prepared using a mixture of n-heptane and toluene as the solvent (25 vol. % toluene for solution II and 50 vol. % toluene for solution II). We chose the volume percentages for toluene to bracket the United States aromatics specification of 35 vol. % in diesel (see Federal Register, Rules and Regulations. Environmental Protection Agency, 40 CFR Parts 69, 80, and 86, Control of air pollution from new motor vehicles: Heavy-duty engine and vehicle standards and highway diesel fuel sulfur control requirements; Final Rule. Vol. 66, No. 12, 2001). California has a still lower specification of 10 vol. % in diesel. Thus, our data represent the high end of what would be found in a commercial diesel product.

Table 1 shows the results for binding capacities of 4,6-DMDBT and DMN on TAPA-functionalized silica-I in pure n-heptane and mixtures of n-heptane and toluene. The equilibrium concentration of 4,6-DMDBT was 0.44 mg/g in n-heptane. In previous work, we measured the binding capacity of 4,6-DMDBT on TAPA-functionalized silica-I in pure n-heptane to be 2.2 mg/g silica at an equivalent equilibrium concentration. By comparison, the presence of DMN in solution did not affect the binding capacity of 4,6-DMDBT, even though almost the same mass of DMN was co-adsorbed on the surface. However, when toluene was used as a co-solvent, in place of pure n-heptane, the binding capacity of 4,6-DMDBT decreased from 2.7 to 2.2 mg/g silica with 25 vol. % toluene and to 1.2 mg/g silica with 50 vol. % toluene. This result can be contributed to two factors: Toluene is itself a π-rich aromatic solvent that competes with 4,6-DMDBT for the TAPA sites on the adsorbent. Unlike the case with DMN, toluene is present at much higher concentrations than 4,6-DMDBT (~1000 times higher for solution II). Any selectivity that TAPA has for 4,6-DMDBT over toluene is overwhelmed by this large concentration difference. Furthermore, 4,6-DMDBT is expected to have better solubility in an aromatic such as toluene than an aliphatic hydrocarbon like n-heptane, thus it will have lower chemical potential in the aromatic solutions. The driving force for adsorption is thus lowered.

b. Adsorption Studies for TAPA-Functionalized Silicas Using Model Diesel

TAPA-functionalized silica-I and TAPA-functionalized silica-II were tested in batch adsorption studies with model diesel containing both 4,6-DMDBT and DBT. Using the GC calibration curves for 4,6-DMDBT and DBT standardized against 9-fluorenone, the initial concentrations of 4,6-DMDBT and DBT in the model diesel feed were measured to be 282 ppm and 247 ppm, respectively, giving an initial total atomic sulfur concentration of 86 ppm.

Measured masses (0.2 g) of each adsorbent were contacted with measured masses (2 g, equivalent to 2.5 ml based on the density of 0.803 g/ml for the model diesel. Table 2 summarizes the results of adsorption tests. The binding capacities (on both mass and molar bases) were higher on all adsorbents for 4,6-DMDBT than for DBT, suggesting that the grafted TAPA functionality forms a stronger interaction with 4,6-DMDBT than DBT. This result is consistent with the fact that methyl groups on the 4,6-DMDBT are electron donating to the rings. Capacities were lower for 4,6-DMDBT in model diesel compared to n-heptane or toluene:n-heptane mixed solvents; although, the initial concentrations in model diesel were also lower by 200 ppm. To compare results on the basis of equivalent equilibrium 4,6-DMDBT concentration, we used the Langmuir model with parameters as fully described in commonly assigned, pending U.S. patent application Ser. No. 12/134,311. For the capacity of 4,6-DMDBT on silica-I at 243 ppm (the equilibrium concentration) in n-heptane, we expect a capacity of 1.44 mg/g. In Table 2, we find the capacity value in diesel to be 0.36 mg/g for 4,6-DMDBT. Thus, this material maintains 25% capacity for 4,6-DMDBT in the model diesel feed, relative to the ideal case (100% n-heptane with no competing species). Higher surface area silica yielded higher capacities; however, as described in commonly assigned, pending U.S. patent application Ser. No. 12/134,311, the capacities do not increase in linear proportion to the increase in surface area.

c. Regeneration of Loaded Adsorbents

Tables 3-5 summarize the regeneration results for TAPA-functionalized silica-I and silica-II. In these tables, adsorbed mass refers to the composite mass uptake (surface excess). Mass in pores refers to the mass of 4,6-DMDBT and DBT in the pores as a result of pore filling by the bulk solution. Total mass adsorbed is the individual mass uptake (composite uptake+mass in the pores).

Table 3 shows the results for regeneration of silica-I that had been loaded with 4,6-DMDBT to different capacities, from 9-18 mg DMDBT/g adsorbent. The results demonstrate that within experimental uncertainties, all of the adsorbed 4,6-DMDBT was recovered completely by toluene regeneration at 70° C. and 2 hr contact time. Tables 4 and 5 show results for regeneration of silica-I and silica-II that had been loaded with 4,6-DMDBT and DBT from model diesel. Here again, within experimental uncertainties, all of the adsorbed 4,6-DMDBT was recovered completely by toluene regeneration at 70° C. (Table 4) and 75±20% of the adsorbed DBT was recovered using these conditions (Table 5).

CONCLUSIONS

Competitive adsorption studies demonstrated that the presence of a structurally similar, non-sulfur containing sorptive at equivalent concentration to 4,6-DMDBT in n-heptane did not impact the binding capacities of 4,6-DMDBT on TAPA-functionalized silicas, but the addition of significant volume percentages of toluene as one of the solvents decreased the binding capacities of 4,6-DMDBT on the functionalized surfaces. Adsorption capacity for 4,6-DMDBT from model diesel was maintained to 25% of the ideal case for 4,6-DMDBT in a non-aromatic solvent with no competing species. For regeneration of DMDBT-loaded, TAPA-functionalized silica, the recovery efficiencies of 4,6-DMDBT and DBT were 100% and 75±20% when toluene was used as the regenerant at 70° C.

TABLE 1

Binding capacities for adsorption of 4,6-DMDBT and DMN on TAPA-functionalized silicas at 25° C. in n-heptane and n-heptane/toluene mixtures. The initial concentrations of 4,6-DMDBT and DMN were 505 ppm and 497 ppm, respectively. The initial atomic sulfur concentration was 78 ppm.

| | Binding capacities in n-heptane | | Binding capacities in toluene:n-heptane (25:75 vol %) | | Binding capacities in toluene:n-heptane (50:50 vol %) | |
|---|---|---|---|---|---|---|
| Sample | DMDBT (mg/g silica) | DMN (mg/g silica) | DMDBT (mg/g silica) | DMN (mg/g silica) | DMDBT (mg/g silica) | DMN (mg/g silica) |
| TAPA-Silica-I | 2.7 ± 0.4 | 2.3 ± 0.3 | 2.2 ± 0.4 | 1.9 ± 0.2 | 1.2 ± 0.4 | 1.0 ± 0.2 |

TABLE 2

Binding capacities for adsorption of 4,6-DMDBT and DBT on TAPA-functionalized silicas at 25° C. in model diesel.

| | Initial concentrations (ppm) | | Final concentrations (ppm) | | | Binding capacities in model diesel (mg/g silica) | | |
|---|---|---|---|---|---|---|---|---|
| Samples | DMDBT | DBT | DMDBT | DBT | Total sulfur* | DMDBT | DBT | Total sulfur* |
| TAPA-Silica-I | 282 | 247 | 243 | 219 | 75 | 0.36 | 0.26 | 0.10 |
| TAPA-Silica-II | 282 | 247 | 206 | 185 | 63 | 0.66 | 0.54 | 0.20 |

*Note: Sulfur content consists of 15.10% and 17.40% of molecular weight in 4,6-DMDBT and DBT respectively.

TABLE 3

Regeneration results for TAPA-functionalized silica-I using toluene as regenerant at 70° C. The samples were contacted with solutions of 4,6-DMDBT in n-heptane. Data are shown for 4,6-DMDBT loading and recovery.

| TAPA-Silica-I (g) | Adsorbed DMDBT (mg) | DMDBT in pores (mg) | Total sorbed DMDBT (mg) | Toluene (mL) | Final DMDBT concentration (ng/μL) | Desorbed DMDBT (mg) |
|---|---|---|---|---|---|---|
| 0.3312 | 3.3 | 0.4 | 3.7 | 29.79 | 123.79 | 3.7 ± 0.1 |
| 0.3316 | 3.3 | 0.4 | 3.7 | 40.26 | 92.57 | 3.7 ± 0.1 |
| 0.1522 | 1.4 | 0.7 | 2.1 | 10.09 | 228.10 | 2.3 ± 0.1 |
| 0.1894 | 1.7 | 0.8 | 2.5 | 20.22 | 132.44 | 2.7 ± 0.1 |
| 0.2041 | 1.8 | 0.9 | 2.7 | 29.77 | 123.79 | 2.8 ± 0.1 |
| 0.2147 | 1.9 | 1.0 | 2.9 | 42.24 | 92.57 | 2.9 ± 0.1 |

50

TABLE 4

Regeneration results for TAPA-functionalized silicas using toluene as regenerant at 70° C. The samples were contacted with model diesel spiked with 4,6-DMDBT and DBT. Data are shown for 4,6-DMDBT loading and recovery.

| Samples | Mass of adsorbent (g) | Adsorbed DMDBT (mg) | DMDBT in pores (mg) | Total sorbed DMDBT (mg) | Toluene (ml) | Final DMDBT concentration (ng/μL) | Desorbed DMDBT (mg) |
|---|---|---|---|---|---|---|---|
| TAPA-Silica-I | 0.3603 | 0.08 | 0.05 | 0.13 | 4.12 | 34.77 | 0.14 ± 0.1 |
| TAPA-Silica-II | 0.3772 | 0.15 | 0.07 | 0.22 | 4.16 | 50.88 | 0.21 ± 0.1 |

TABLE 5

Regeneration results for TAPA-functionalized silicas using toluene as regenerant at 70° C. The samples were contacted with model diesel spiked with 4,6-DMDBT and DBT. Data are shown for DBT loading and recovery.

| Samples | Mass of adsorbent (g) | Adsorbed DBT (mg) | DBT in pores (mg) | Total sorbed DBT (mg) | Toluene (ml) | Final DBT conc. (ng/μL) | Desorbed DBT (mg) |
|---|---|---|---|---|---|---|---|
| TAPA-Silica-I | 0.3603 | 0.06 | 0.05 | 0.11 | 4.12 | 17.08 | 0.07 ± 0.1 |
| TAPA-Silica-II | 0.3772 | 0.13 | 0.06 | 0.19 | 4.16 | 40.44 | 0.17 ± 0.1 |

What is claimed is:

1. A process for adsorbing aromatic sulfur compounds comprising contacting at least one adsorbent with a $C_6$-$C_{20}$ aromatic and/or aliphatic stream which comprises a solution of (i) at least one benzothiophene compound, (ii) a solvent which comprises at least one $C_6$-$C_{16}$ aliphatic compound, and (iii) optionally at least one $C_6$-$C_{12}$ aromatic compound, wherein the adsorbent comprises a 2,4,5,7-tetranitro-9-fluorenylideneaminooxy propionic acid (TAPA) functionalized silica.

2. The process of claim 1, wherein said at least one benzothiophene compound comprises a 4,6-dimethyldibenzothiophene compound.

3. The process of claim 1, wherein said $C_6$-$C_{12}$ aromatic compound comprises 2,6-dimethylnaphthalene.

4. The process of claim 1, wherein said $C_6$-$C_{12}$ aromatic compound comprises toluene.

5. The process of claim 1, wherein said $C_6$-$C_{16}$ aliphatic compound comprises n-heptane.

6. The process of claim 2, further comprising a binding capacity of at least about 1.2 to about 2.7 mg 4,6-dimethyldibenzothiophene compound per gram of adsorbent.

7. The process of claim 1, wherein said adsorbent is regenerated using a $C_6$-$C_8$ aromatic compound as a regenerant at temperatures between about 50° C. and about 100° C.

8. The process of claim 7, wherein said $C_6$-$C_8$ aromatic compound comprises toluene.

9. The process of claim 1, wherein said $C_6$-$C_{20}$ aromatic and/or aliphatic stream comprises a total sulfur concentration between about 70 ppm and about 100 ppm.

10. A process for adsorbing aromatic sulfur compounds comprising contacting at least one adsorbent with a model diesel feed comprising at least one benzothiophene compound, and wherein the adsorbent comprises a 2,4,5,7-tetranitro-9-fluorenylideneaminooxy propionic acid (TAPA) functionalized silica.

11. The process of claim 10, wherein said at least one benzothiophene compound comprises a mixture of a 4,6-dimethyldibenzothiophene compound and a dibenzothiophene compound.

12. The process of claim 11, further comprising a binding capacity of at least about 0.3 mg 4,6-dimethyldibenzothiophene compound per gram of said at least one adsorbent.

13. The process of claim 11, further comprising a binding capacity of at least about 0.2 mg dibenzothiophene compound per gram of adsorbent.

14. The process of claim 10, wherein said adsorbent is regenerated using a $C_6$-$C_8$ aromatic compound as a regenerant at temperatures between about 50° C. and about 100° C.

15. The process of claim 14, wherein said $C_6$-$C_8$ aromatic compound comprises toluene.

16. The process of claim 10, wherein said model diesel feed comprises a total sulfur concentration between about 70 ppm and about 100 ppm.

17. A process for adsorbing aromatic sulfur compounds from at least one hydrocarbon stream by contacting the stream with an adsorbent comprising a 2,4,5,7-tetranitro-9-fluorenylideneaminooxy propionic acid functionalized silica, wherein the hydrocarbon stream comprises any of naphtha, gasoline, commercial diesel fuel, model diesel fuel, and jet fuel.

18. The process of claim 17, wherein the aromatic sulfur compounds comprise benzothiophene and derivatives thereof.

19. The process of claim 18, wherein the benzothiophene and derivatives thereof comprise a mixture of a 4,6-dimethyldibenzothiophene compound and a dibenzothiophene compound.

20. The process of claim 17, wherein the adsorbent is regenerated using a $C_6$-$C_8$ aromatic compound as a regenerant at temperatures between about 50° C. and about 100° C.

* * * * *